US006186845B1

(12) United States Patent
Head

(10) Patent No.: US 6,186,845 B1
(45) Date of Patent: Feb. 13, 2001

(54) MOTOR MOUNTING STRUCTURE FOR BOAT

(76) Inventor: Michael Alan Beachy Head, 11 Upper Thistle Street, Cape Town (ZA), 7700

( * ) Notice: Under 35 U.S.C. 154(b), the term of this patent shall be extended for 0 days.

(21) Appl. No.: 09/237,841

(22) Filed: Jan. 27, 1999

(30) Foreign Application Priority Data

Jan. 28, 1998 (ZA) ..... 98/0695

(51) Int. Cl.[7] ..... B63H 20/08
(52) U.S. Cl. ..... 440/57; 440/111
(58) Field of Search ..... 440/55, 57, 111, 440/112

(56) References Cited

U.S. PATENT DOCUMENTS

| | | | |
|---|---|---|---|
| 1,659,580 | 2/1928 | Weller . | |
| 1,737,180 | 11/1929 | Willis . | |
| 1,911,192 | 5/1933 | Harvey . | |
| 2,209,302 | 7/1940 | Johnson et al. . | |
| 2,569,686 | 10/1951 | Melchior . | |
| 2,633,817 | 4/1953 | Pedranti . | |
| 2,682,854 | 7/1954 | Cohen . | |
| 2,976,836 | 3/1961 | Fageol . | |
| 3,136,288 | 6/1964 | Hardy . | |
| 3,148,657 | 9/1964 | Horning . | |
| 3,164,122 | 1/1965 | Fageol . | |
| 3,175,530 * | 3/1965 | Petterson | 440/57 |
| 3,382,839 | 5/1968 | Kiekhaefer . | |
| 3,452,704 | 7/1969 | Watkins . | |
| 4,236,478 | 12/1980 | Mansson | 440/112 |
| 4,907,994 | 3/1990 | Jones | 440/61 |
| 4,911,666 | 3/1990 | Gage et al. | 440/89 |
| 5,108,325 | 4/1992 | Livingston et al. | 440/112 |
| 5,401,197 | 3/1995 | Kobayashi | 440/38 |

* cited by examiner

*Primary Examiner*—S. Joseph Morano
*Assistant Examiner*—Andrew D. Wright
(74) *Attorney, Agent, or Firm*—Vorys, Sater, Seymour and Pease LLP

(57) ABSTRACT

A mount for an outboard motor is disclosed in which the cylinder block of the motor is within the hull and the gear box and propeller are outside the hull. The drive shaft passes through the mount from the block to the gear box. The mount permits the motor to be swung about a horizontal axis to raise and lower the propeller. It also permits the motor to perform rotary steering oscillations about an inclined axis which passes through the propeller, or close to the propeller. Because the propeller is oscillated about an axis which passes through or close to it, it remains on the boat center line when the motor is turned for steering purposes and moves to a position in which the line of thrust is downwards.

14 Claims, 5 Drawing Sheets

MOTOR MOUNTING STRUCTURE FOR BOAT

FIELD OF THE INVENTION

THIS INVENTION relates to motor mounting structures for boats.

BACKGROUND TO THE INVENTION

Small water craft, meaning inflatable boats and rigid hulled boats of up to about eight meters, are usually powered by one (or more) outboard motors attached to a rear transom. The drive shaft of the motor is substantially vertical. At the lower end of the drive shaft there is a gear box through which drive is transmitted to a substantially horizontal propeller shaft. The main advantage of an outboard motor is that the power losses in the drive train between the crank shaft and the propeller shaft are small. The main disadvantages of an outboard motor are that it occupies space at the stern end of the deck thereby reducing available deck space, it is noisy and is unsightly.

Inboard motors are rarely found on the smallest boats where outboards are used almost exclusively. Larger boats use almost exclusively inboard engines. However, there is a size range (say from four meters to eight meters) where some boats have outboard motors and others have inboard motors. An inboard motor is entirely concealed within the structure of the hull and the boat is thus more aesthetically pleasing. The main disadvantage of the inboard motor is that the crank shaft of the motor rotates about a horizontal axis and the propeller shaft also rotates about a horizontal axis but at a lower level. Hence two sets of gearing, usually bevel gearing, and an intermediate shaft, are required to form a power train from the crank shaft to the propeller shaft. Power losses are hence substantial. For this reason inboard and outboard motors of the same rated power will provide substantially different powers at the propeller. As much as thirty percent more power can be lost in the drive train of an inboard motor than in the drive train of an outboard motor.

An inboard motor is approximately twice the weight of an outboard motor for the same power.

Motor mountings have been proposed in which the motor's block is within the hull of the boat, the drive shaft passing through a transom and there being a gear box and propeller externally of the hull. An example of a motor mounting of this type is found in U.S. Pat. No. 3,382,839.

The main object of the present invention is to provide a motor mounting which provides the boat with advantageous handling characteristics.

BRIEF DESCRIPTION OF THE INVENTION

According to one aspect of the present invention there is provided, in combination, an outboard motor having a block, a housing extending downwardly from the block, a gear box within a lower part of said housing, a drive shaft extending from the block to said gear box, a propeller shaft extending rearwardly from said gear box and rotatable about an axis, and a propeller comprising a hub and blades protruding from the hub, the propeller being astern of said housing, a hull including an inclined transom, and means mounting said housing, drive shaft, gear box and propeller on said transom for oscillatory steering movements about an inclined axis which intersects, at a point of intersection astern of said housing, said axis about which the propeller rotates.

Said point of intersection is preferably between a front end of said hub and a rear end of said hub.

According to a further aspect of the present invention there is provided a boat having a hull including an inclined transom, an outboard motor and a mounting structure mounting said motor on said transom for rotary oscillatory steering movements about an inclined axis, a block of the motor being within the hull, a propeller of the motor being outside the hull and a drive shaft of the motor passing through the mounting from said block to drive said propeller, said propeller being mounted for rotation about a drive axis, said mounting structure including means permitting said motor to rotate about a horizontal axis to displace said propeller between a lowered operative position and a raised inoperative position, said inclined axis and said drive axis intersecting to the rear of a vertical line which intersects both said drive axis and said horizontal axis.

Said propeller preferably includes a hub having a front end and a rear end, said inclined axis intersecting said drive axis between said front and rear ends.

Hydraulic cylinders mounted between said motor and a fixed anchorage can be provided for displacing said motor in propeller lifting and lowering movements about said horizontal axis.

In the preferred form said mounting comprises an outer component mounted on said transom for rotary oscillation about said inclined axis and an inner component mounted on said outer component for rotary oscillation with respect to said outer component about said horizontal axis, said motor being carried by said inner component.

According to another aspect of the present invention there is provided, in combination, an outboard motor having a block, a propeller below and to the rear of the block in relation to the direction in which the motor travels, a drive shaft extending downwardly from the block to drive said propeller, the propeller being rotatable about a drive axis and having a hub with a front end and a rear end and blades protruding therefrom, and a mounting structure which includes means for permitting said motor to perform rotary oscillations about a horizontal axis to displace said propeller between a lowered operative position and a raised inoperative position, and means for permitting said motor to perform rotary steering oscillations about an inclined axis, said inclined axis intersecting said drive axis rearwardly of a vertical line which intersects said drive axis and said horizontal axis.

Said inclined axis preferably intersects said drive axis between said front and rear ends of said hub.

In a preferred form said mounting structure includes an outer component for attachment to an inclined transom of a boat, an intermediate component carried by said outer component and free to perform rotary steering oscillations with respect to said outer component about said inclined axis, and an inner component carried by said intermediate component and free to perform rotary oscillations with respect to said intermediate component about said horizontal axis.

According to yet another aspect of the present invention there is provided a boat having a hull, an outboard motor passing through an inclined rear transom of the hull with a block of the motor inside the hull and a propeller outside the hull and mounted on the transom for a first movement about a horizontal axis to enable the propeller to be lowered to an operative position and raised to an inoperative condition, and a second steering movement about an inclined axis which passes close to, or through, the propeller so that the propeller turns on itself thereby to minimise movement of the propeller off the centre line of the boat during steering.

BRIEF DESCRIPTION OF THE DRAWINGS

For a better understanding of the present invention, and to show how the same may be carried into effect, reference will now be made, by way of example, to the accompanying drawings in which.

DESCRIPTION OF THE PREFERRED EMBODIMENTS

Figure 1:
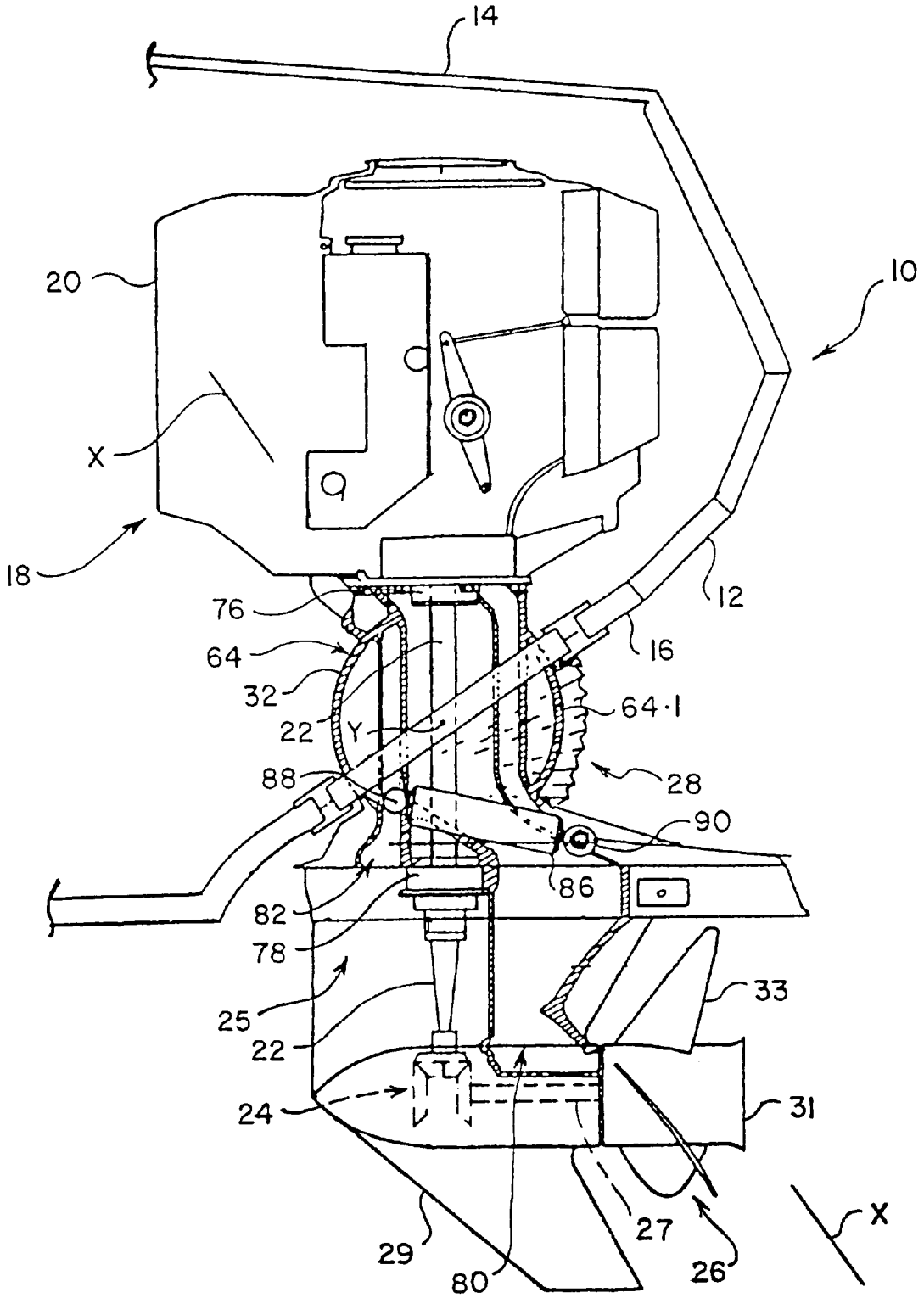
FIG. 1 is a diagrammatic side elevation of an outboard motor and motor mount in accordance with the present invention.

Referring firstly to FIG. 1, reference numeral 10 designates the hull of a boat, the hull including a stern portion 12 and a deck 14. Part of the stern portion 12, this part being designated 16, forms a transom and lies at an angle to the horizontal. The preferred angle is between 35° and 45°.

An outboard motor designated 18 is mounted on the transom 16, the engine block 20 being within the hull 10. The drive shaft 22 of the motor passes through the transom 16, and the gear box 24 and propeller 26 of the motor are external of the hull 10. The lowermost part of the shaft 22 and gear box 24 are within a vertically elongate fairing 25 which also houses the propeller shaft 27. A skeg 29 protrudes downwardly from the fairing 25. The propeller 26 comprises a hub 31 and blades 33 protruding from the hub 31.

Between the block 20 and the gear box 24 there is a motor mount generally designated 28. The motor mount comprises a rotatable ring 30, the inclined axis about which the ring 30 can rotate being shown at X. The ring 30 forms the external component of a gimbal, the internal component of the gimbal being constituted by a structure which is generally designated 32.

The ring 30 is sandwiched between non-rotatable upper and lower rings 34, 36 (see FIG. 3), there being ball or roller bearings 38 and 40 between the ring 30 and the rings 34 and 36.

Surrounding the rings 30, 34 and 36 and the bearings 38 and 40 is a split collar 42, the two halves of the collar 42 being secured together by means of studs 44. The split collar has an internal recess 46 which receives the peripheries of the three rings 30, 34 and 36. The collar includes four pairs of lobes 48 and 50 (see FIGS. 2 and 3). The lobe 50 of each pair is formed with a threaded bore 52 and the other lobe 48 of each pair is formed with a socket 54 for receiving the Allen head of a bolt 56. Each bolt 56 passes through the transom 16 of the hull 10, the head of each bolt 56 being in one of the sockets 54 and the shaft of each bolt 56 being screwed into one of the bores 52.

O-ring seals 58 encircle the rings 34 and 36 and seal between these rings and the split collar 42. Packings 60 and 62 seal between the split collar 42 and the transom 16 and around the bolts 56 respectively.

The structure 32 comprises a disc 35 and a casing designated 64 which is entirely surrounded by the disc 35. Opposite end parts 64.1 of the casing 64 are of part spherical form and the wall parts 64.2 which join the wall end parts 64.1 are flat (see FIG. 2). At two diametrically opposed locations (see FIG. 2) there are tapered bolts 66 which secure the disc 35 to the ring 30. The heads of the bolts 66 are in recesses in the outer periphery of the ring 30 and the bolts pass radially through the ring and into the blind bores in the disc 38. This enables the structure 32 to pivot about the axis designated Y. This axis is indicated as a line in FIG. 2 and is shown as a dot in each of FIGS. 1 and 3 as it is at right angles to the plane of the drawing.

Internally of the casing 64 the structure 32 comprises a sleeve 70. Within the sleeve 70 there are longitudinally extending ribs 72 and a tube 74 (only shown in FIG. 2). The drive shaft 22 passes through the tube 74. Upper and lower bearings 76, 78 for the shaft 22 are mounted at the upper and lower ends of the tube 74. The casing 64 and sleeve 70 extend downwardly to the region of the propeller 26. The space within the sleeve 70 is, at its upper end, connected to the exhaust port of the engine. Thus exhaust gasses from the engine flow downwardly through the vertical passageways bounded by the sleeve 70, ribs 72 and tube 74 to escape below water level. The exit from these vertical passageways is designated 80 in FIG. 1.

The casing 64 forms a water jacket that encircles the exhaust gasses sleeve 70. A water pump (not shown) located within the fairing 25 pumps water upwardly through casing 64 (the water inlet to the casing 64 being shown at 82) and into the motor for cooling purposes. The water escapes from the motor through the normal outlet ports provided.

Figure 2:
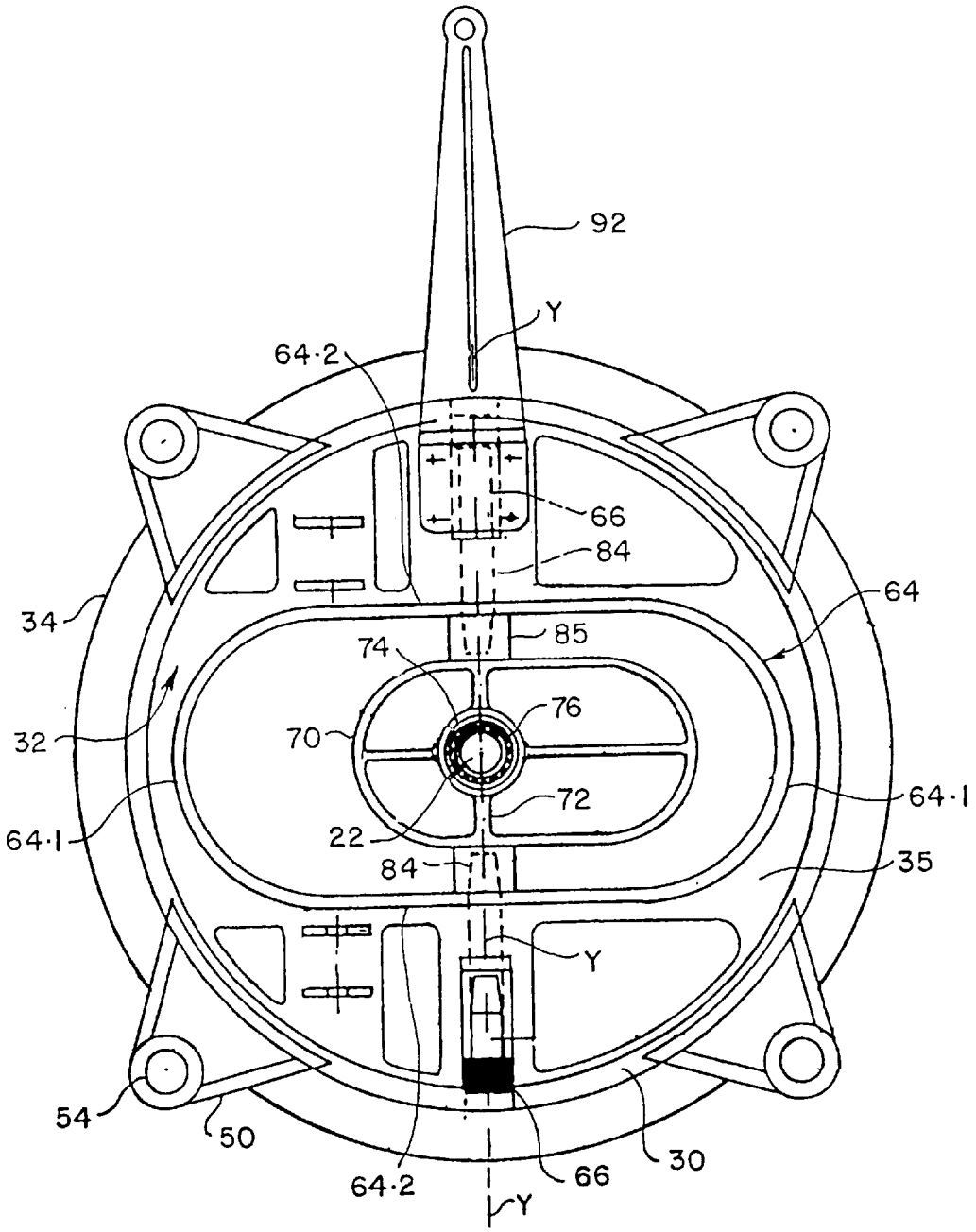
FIG. 2 is a plan view, to a larger scale, of part of the motor mount of FIG. 1

The disc 35, casing 64 and sleeve 70 are connected together by means of tapered pivot pins 84 (FIG. 2). The pins 84 enter bosses 85 protruding from the sleeve 70. The casing 64 and sleeve 70 are not only free to rotate about the axis of the shaft 22 but are also able to tilt about the axis Y with respect to the disc 35. The motor can thus be tilted.

An hydraulic cylinder 86 (FIG. 1) is connected between an anchorage 88 on the ring 30 and an anchorage 90 on the structure 32. In FIG. 1 the hydraulic cylinder 86 is shown in its retracted condition. When extended it pushes the lower part of the structure 32 to the right thereby tilting the motor 18, the structure 32, the gear box 24 and the propeller 26 about the axis Y.

A steering arm 92 protrudes from the disc 35. Movement of the steering arm 92 to the left or right as viewed in FIG. 2 turns the motor 18, gear box 24 and propeller 26 about the axis X.

Figure 4:
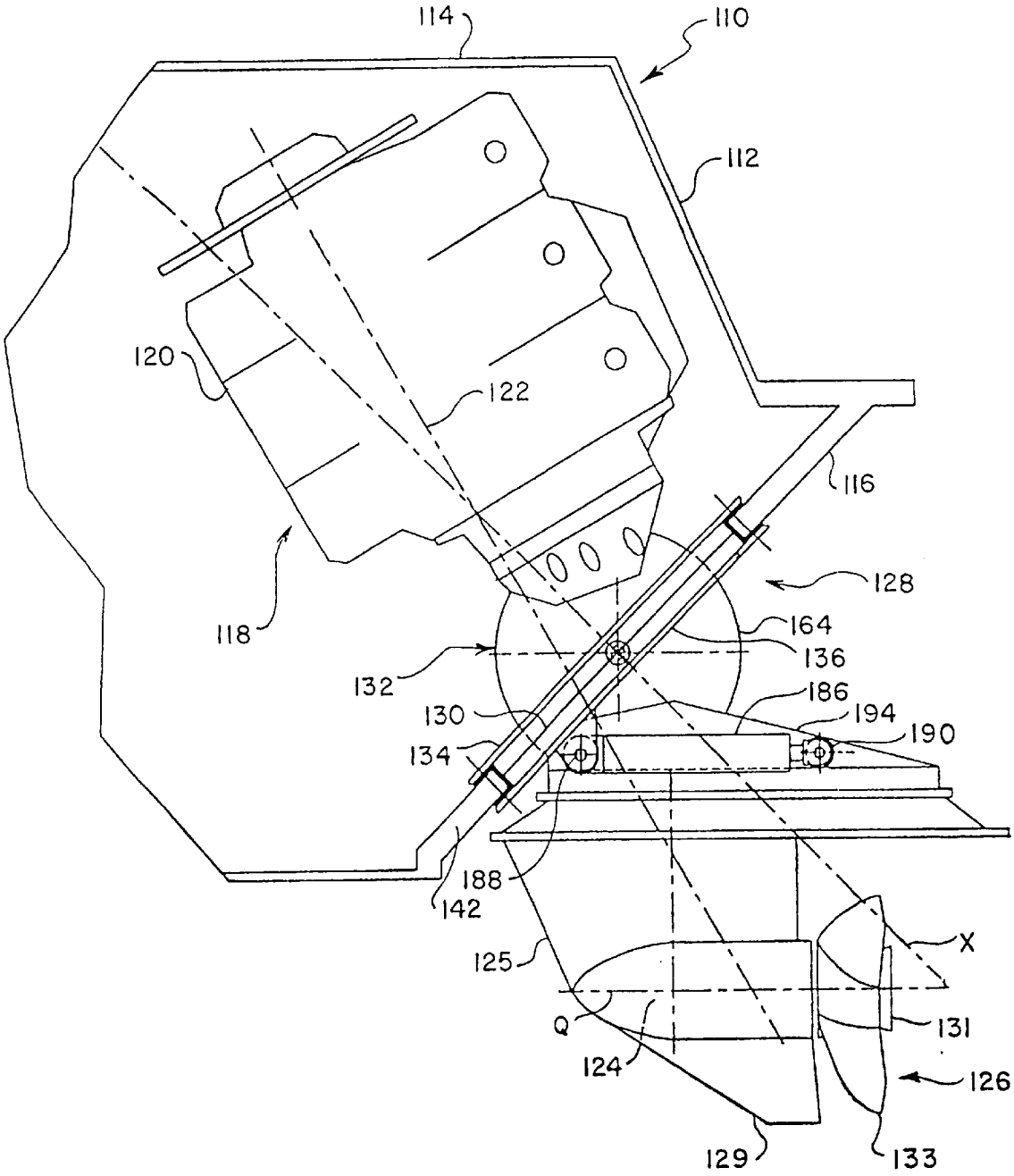
FIGS. 4 and 5 are diagrammatic side elevations showing a motor and motor mount with the motor in lowered and raised positions respectively.
Figure 5:
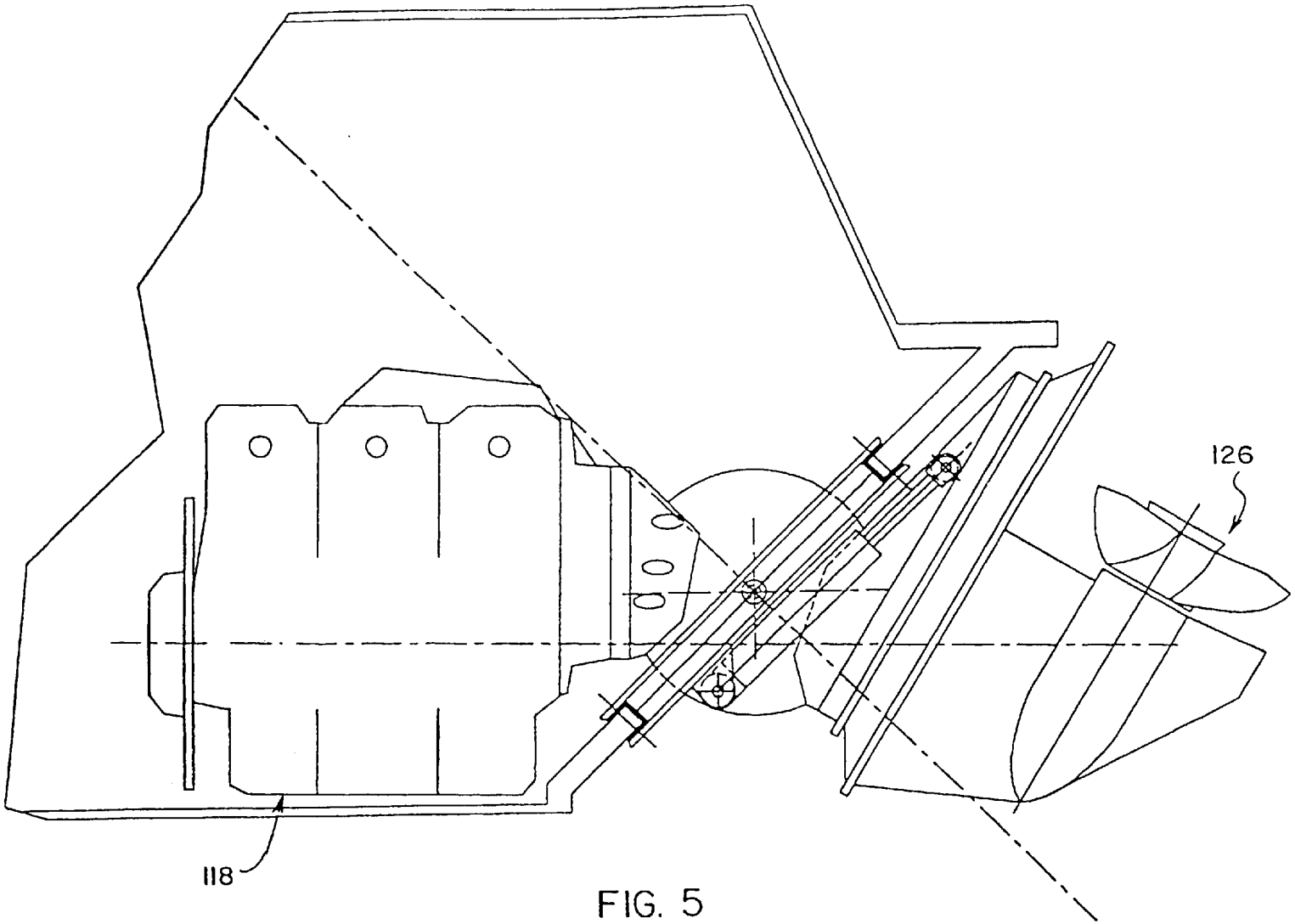
Figure 6:
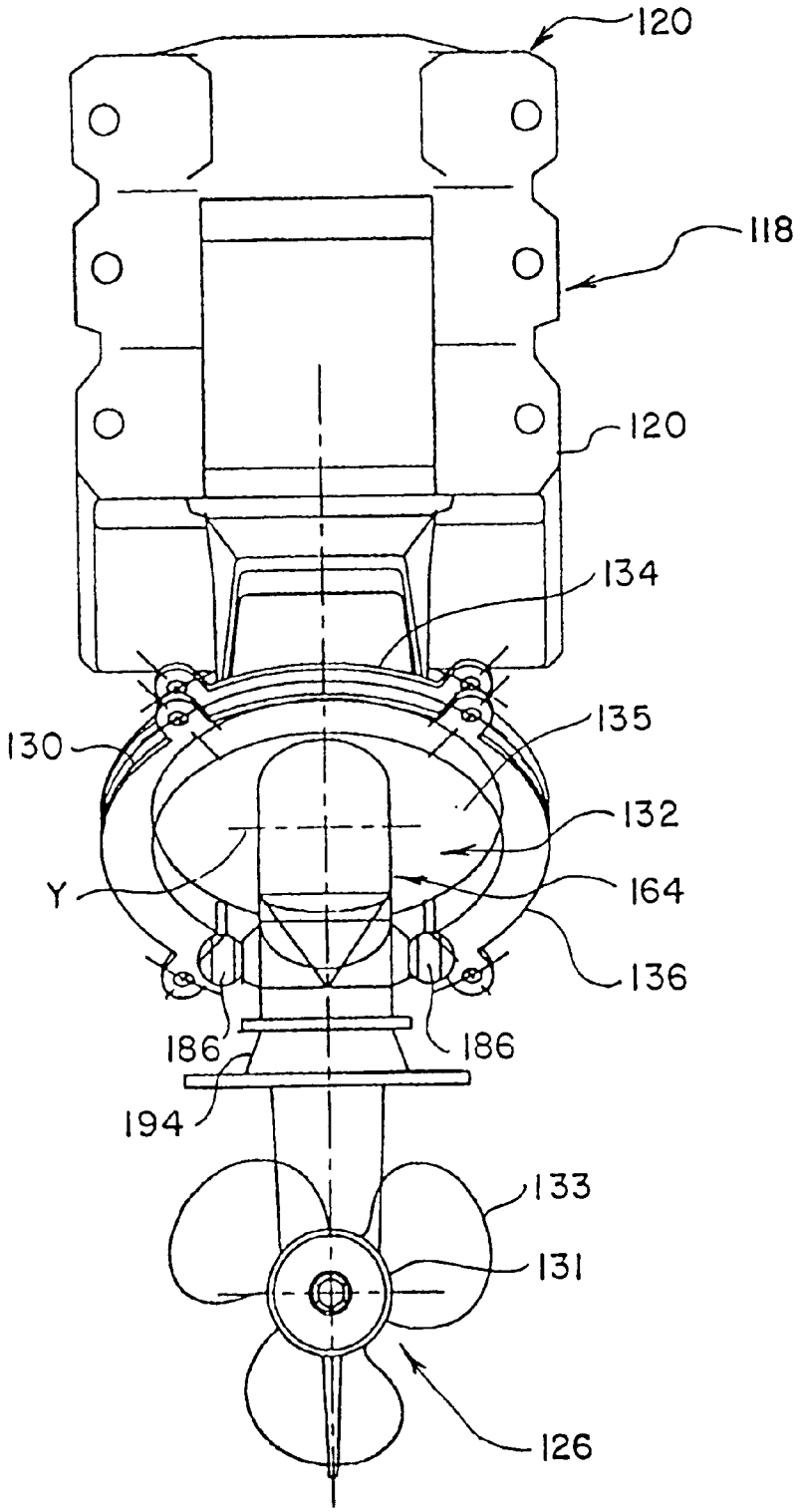
FIG. 6 is a view of the motor and motor mount of FIGS. 4 and 5 as seen from the rear of the boat.

Referring to FIGS. 4 to 6, reference numeral 110 designates the hull of a boat, the hull including a stern portion 112 and a deck 114. Part of the stern portion 112, this part being designated 116 and forming a transom, lies at an angle to the horizontal. The preferred angle is between 35° and 45°.

Figure 3:
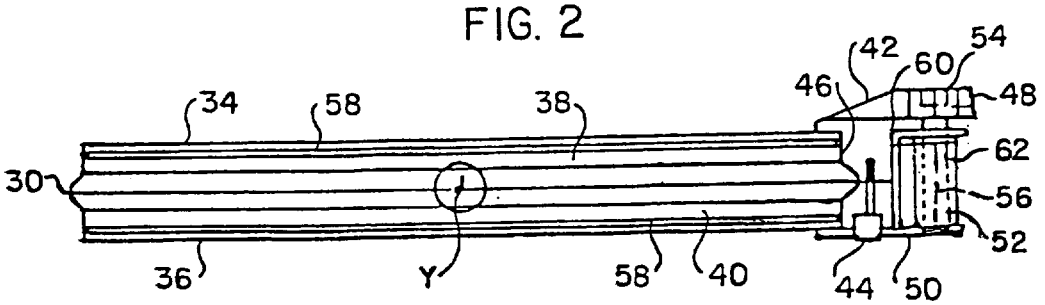
FIG. 3 is a detail of a mounting ring and associated structure.

An outboard motor designated 118 is mounted on the transom 116, the motor's block 120 being within the hull 110. The drive shaft 122 of the motor passes through the transom 116, and the fairing 125, the propeller 126 and the skeg 129 are external of the hull 110. The shaft 122 is indicated by means of its centre line only and it will be noted that it is inclined to the vertical at an angle of about 60 degrees. In FIGS. 1 to 3 the drive shaft 22 is vertical and co-axial with the ring 30. In FIGS. 4 to 6 the drive shaft is offset in the forward direction from the axis of the ring 130.

Between the block 120 and the gear box 124 there is a motor mount generally designated 128. The motor mount comprises a rotatable ring 130, the axis about which the ring 130 can rotate being shown at X. The ring 130 forms an external component of a gimbal, an internal component of the gimbal being constituted by a structure generally designated 132.

The ring 130 is sandwiched between non-rotatable upper and lower rings 134, 136, there being ball or roller bearings (not shown) between the ring 130 and the rings 134 and 136. The rings are mounted on the transom 116 by means of a split collar 142.

The structure 132 includes an outer casing 164 of part spherical form. The structure 132 is mounted on the ring 130 as described above with reference to FIGS. 1 to 3.

Parallel hydraulic cylinders 186 are connected between anchorages 188 on the ring 130 and anchorages 190 on the structure 132. The cylinders 186 lie on opposite sides of a heel plate 194 forming part of the structure 132. In FIG. 4 the hydraulic cylinder 186 is shown in its retracted condition. When extended it pushes the lower part of the structure 132 to the right thereby tilting the motor 118, the casing 132, the gear box 124 and the propeller 126 about the axis Y from the position shown in FIG. 4 to the position shown in FIG. 5.

Operation of the motor will now be described by way of example with reference to FIGS. 4 to 6. In normal operation the motor is positioned as shown in FIG. 4, or possibly slightly trimmed down from the position illustrated. The line of thrust is thus horizontal or, if the motor is trimmed down, at a shallow angle to horizontal. In this latter arrangement the thrust pushes the stern of the boat down and lifts the bow. The cylinders 186 shown in FIG. 4 are in their retracted positions and hold the motor 118 in the position shown. Trimming down the motor involves feeding hydraulic fluid to the left hand ends of the cylinders 186 to tilt the motor anti-clockwise through a few degrees.

To displace the motor to its raised, inoperative position behind the transom 116 (FIG. 5), the hydraulic cylinders 186 are fully extended. The motor 118 and casing 132 pivot about the axis Y whilst moving between the operative and retracted positions.

The X axis, the axis about which the ring 130 rotates, as clearly seen in FIG. 4, intersects the axis Q of the propeller shaft at a position just to the rear of the propeller 126. The position of the point of intersection varies with the transom angle. If the angle is less than that shown, which is about 45 degrees, the point of intersection moves to the left in FIG. 4. A transom angle of about 35 degrees is the minimum that achieves the objects of the invention. At any lesser angle the point of intersection is ahead of the hub 131 on which the propeller blades 133 are mounted and, for the reasons set out below, the advantages which are obtained with a transom angle of above 35 degrees are lost. Preferably the point of intersection is between the front and rear ends of the hub 131.

When the motor 120 is rotated about the axis X to turn the boat, the fact that the propeller is intersected by the axis X means that it turns on itself rather than moving along an arc. Movement of the propeller along an arc would result from the axis X intersecting the axis Q too far forward or too far astern of the propeller. In other words, a transom angle which is too big or too small displaces the point of intersection too far from the propeller. Because the propeller rotates about an axis passing through it, it remains on the boat's centre line.

The fairing 125 which contains the gear box and water pump, and downwardly from which the skeg 129 projects, moves in an arc which lies parallel to the ring 132. The fairing thus moves to a position which is skewed with respect to the direction in which water flows past the boat. The flowing water impinges on those sides of the fairing 125 and skeg 129 which are presented to it, and the lateral component of the resultant force on the fairing and skeg turns the boat. The turning force is thus exerted on the leading edge of the fairing and skeg rather than on the trailing edge.

The fairing and skeg also tilt because the axis about which they have been rotated is inclined. This means that the skeg and fairing surfaces which the water flowing under the boat impinges upon face downwardly and the flowing water thus exerts an upward force on them. There is thus, during turning, an upward force exerted on the rear of the boat. This upward force tends to lift the rear of the boat and push the front down. This inhibits "flipping" of the boat during a tight turn.

Because the propeller does not move in an arc, but merely turns about an axis passing through it, torque forces are reduced and experimental work has shown that the propeller is less prone to cavitation.

What is claimed is:

1. In combination an outboard motor having a block, a housing extending downwardly from the block, a gear box within a lower part of said housing, a drive shaft extending from the block to said gear box, a propeller shaft extending rearwardly from said gear box and rotatable about an axis, and a propeller comprising a hub and blades protruding from the hub, the propeller being astern of said housing, a hull including an inclined transom, and a structure mounting said housing, drive shaft, gear box and propeller on said transom for oscillatory steering movements about an inclined axis which intersects, at a point of intersection astern of said housing, said axis about which the propeller rotates.

2. The combination claimed in claim 1, wherein said point of intersection is between a front end of said hub and a rear end of said hub.

3. A boat having a hull including an inclined transom, an outboard motor and a mounting structure mounting said motor on said transom for rotary oscillatory steering movements about an inclined axis, a block of the motor being within the hull, a propeller of the motor being outside the hull and a drive shaft of the motor passing through the mounting from said block to drive said propeller, said propeller being mounted for rotation about a drive axis, said mounting structure including a structure permitting said motor to rotate about a horizontal axis to displace said propeller between a lowered operative position and a raised inoperative position, said inclined axis and said drive axis intersecting to the rear of a vertical line which intersects both said drive axis and said horizontal axis, said propeller including a hub having a front end and a rear end, said inclined axis intersecting said drive axis between said front and rear ends.

4. A boat as claimed in claim 3, and including hydraulic cylinders mounted between said motor and a fixed anchorage for displacing said motor in propeller lifting and lowering movements about said horizontal axis.

5. A boat as claimed in claim 3, wherein said mounting comprises an outer component mounted on said transom for rotary oscillation about said inclined axis and an inner component mounted on said outer component for rotary oscillation with respect to said outer component about said horizontal axis, said motor being carried by said inner component.

6. In combination an outboard motor having a block, a propeller below and to the rear of the block in relation to the direction in which the motor travels, a drive shaft extending downwardly from the block to drive said propeller, the propeller being rotatable about a drive axis and having a hub with a front end and a rear end and blades protruding therefrom, and a mounting structure which includes a structure for permitting said motor to perform rotary oscillations about a horizontal axis to displace said propeller between a lowered operative position and a raised inoperative position, and a structure permitting said motor to perform rotary steering oscillations about an inclined axis, said drive shaft being rotatable about an axis thereof and said inclined axis intersecting said drive axis rearwardly of a point of intersection between said axis of the drive shaft and said drive axis.

7. The combination claimed in claim 6, wherein said inclined axis intersects said drive axis between said front and rear ends of said hub.

8. The combination claimed in claim 6 wherein said mounting structure includes an outer component for attachment to an inclined transom of a boat, an intermediate component carried by said outer component and free to perform rotary steering oscillations with respect to said outer component about said inclined axis, and an inner component carried by said intermediate component and free to perform rotary oscillations with respect to said intermediate component about said horizontal axis.

9. A boat having a hull, an outboard motor having a drive shaft and a housing which pass through an inclined rear transom of the hull with a block of the motor inside the hull and a propeller outside the hull and rotatable about a drive axis, a structure mounting the motor on the transom for a first movement about a horizontal axis to enable the propeller to be lowered to an operative position and raised to an inoperative condition, and a second steering movement about an inclined axis which is normal to the angle of inclination of the transom and which passes close to, or through, the propeller so that the propeller turns on itself thereby to minimise movement of the propeller off a centre line of the boat during steering, said drive shaft having an axis arranged so that it intersects said axis about which the propeller rotates forwardly, in the direction in which the boat travels, of a point of intersection between said drive axis and said inclined axis.

10. A boat as claimed in claim 9, wherein the axis of the drive shaft is vertical.

11. A boat as claimed in claim 9 wherein the axis of the drive shaft is inclined, the angle at which the drive shaft is inclined being steeper than the angle at which said inclined axis is inclined, said inclined axis and the axis of the drive shaft intersecting above and forwardly of said horizontal axis.

12. A boat having a hull including an inclined transom, an outboard motor and a mounting structure mounting said motor on said transom for rotary oscillatory steering movements about an inclined axis, a block of the motor being within the hull, a propeller of the motor being outside the hull and a drive shaft of the motor passing through the mounting from said block to drive said propeller, said propeller being mounted for rotation about a drive axis, said mounting structure being constructed to permit said motor to rotate about a horizontal axis to displace said propeller between a lowered operative position and a raised inoperative position, said inclined axis and said drive axis intersecting to the rear of a vertical line which intersects both said drive axis and said horizontal axis, said mounting structure comprising an outer component mounted on said transom for rotary oscillation about said inclined axis and an inner component mounted on said outer component for rotary oscillation with respect to said outer component about said horizontal axis, said motor being carried by said inner component.

13. In combination an outboard motor having a block, a propeller below and to the rear of the block in relation to the direction in which the motor travels, a drive shaft extending downwardly from the block to drive said propeller, the propeller being rotatable about a drive axis and having a hub with a front end and a rear end and blades protruding therefrom, and a mounting structure constructed to permit said motor to perform rotary oscillations about a horizontal axis to displace said propeller between a lowered operative position and a raised inoperative position, and to permit said motor to perform rotary steering oscillations about an inclined axis, said inclined axis intersecting said drive axis rearwardly of a vertical line which intersects said drive axis and said horizontal axis and said inclined axis intersecting said drive axis between said front and rear ends of said hub.

14. In combination an outboard motor having a block, a propeller below and to the rear of the block in relation to the direction in which the motor travels, a drive shaft extending downwardly from the block to drive said propeller, the propeller being rotatable about a drive axis and having a hub with a front end and a rear end and blades protruding therefrom, and a mounting structure constructed to permit said motor to perform rotary oscillations about a horizontal axis to displace said propeller between a lowered operative position and a raised inoperative position, and to permit said motor to perform rotary steering oscillations about an inclined axis, said inclined axis intersecting said drive axis rearwardly of a vertical line which intersects said drive axis and said horizontal axis, said mounting structure including an outer component for attachment to an inclined transom of a boat, an intermediate component carried by said outer component and free to perform rotary steering oscillations with respect to said outer component about said inclined axis, and an inner component carried by said intermediate component and free to perform rotary oscillations with respect to said intermediate component about said horizontal axis.

* * * * *